US005980320A

United States Patent [19]

Slack et al.

[11] Patent Number: 5,980,320

[45] Date of Patent: Nov. 9, 1999

[54] ELECTRICAL CONNECTOR HAVING CRIMPED GROUND SHIELD

[75] Inventors: Victor Eugene Slack, Lewisville; Michael Paul Derstine, Winston-Salem, both of N.C.

[73] Assignee: The Whitaker Corporation, Wilmington, Del.

[21] Appl. No.: 08/934,091

[22] Filed: Sep. 19, 1997

[51] Int. Cl.[6] ..... H01R 13/648

[52] U.S. Cl. ..... 439/607; 439/676

[58] Field of Search ..... 439/607, 608, 439/609, 610, 675, 676

[56] References Cited

U.S. PATENT DOCUMENTS

| | | | |
|---|---|---|---|
| 4,789,357 | 12/1988 | Yamaguchi et al. | 439/607 |
| 4,842,554 | 6/1989 | Cosmos et al. | 439/609 |
| 4,938,704 | 7/1990 | Fujiura | 439/95 |
| 5,017,156 | 5/1991 | Sugiyama | 439/607 |
| 5,266,038 | 11/1993 | Nakamura | 439/607 |
| 5,281,169 | 1/1994 | Kiat et al. | 439/607 |
| 5,288,248 | 2/1994 | Chen | 439/607 |
| 5,378,172 | 1/1995 | Roberts | 439/607 |
| 5,788,538 | 8/1998 | Belopolsky et al. | 439/607 |

*Primary Examiner*—Hien Vu
*Attorney, Agent, or Firm*—Robert J. Kapalka

[57] ABSTRACT

An electrical connector includes a dielectric housing which holds a plurality of terminals and a conductive shell which is mounted on the housing. The housing has a wall and a pocket is formed in the wall. The shell has a locking tab which is interference fitted in the pocket, thereby anchoring the shell to the housing. The shell also has a floating tab which is freely received in the pocket and is resiliently engaged with the locking tab.

8 Claims, 4 Drawing Sheets

ELECTRICAL CONNECTOR HAVING CRIMPED GROUND SHIELD

FIELD OF THE INVENTION

The invention relates to an electrical connector having a ground shield, and in particular, to a means for securing the ground shield to the connector.

BACKGROUND OF THE INVENTION

An electrical connector such as a modular jack may have a ground shield which blocks the passage of electromagnetic interference (EMI) both to and from the connector. The ground shield generally comprises an electrically conductive shell which covers an exterior of the connector and is electrically grounded to a frame or chassis of an electrical assembly with which the connector will be used. The shell may be made in one or more pieces which are stamped and formed to closely surround the connector when the shell is applied to the connector. Both a one-piece shell and a multi-piece shell must be securely attached to the connector in order to form an integral unit therewith. A one-piece shell has the advantage that it is seamless, thereby reducing leakage paths for EMI. However, a one-piece shell generally requires complex bending and forming operations during assembly of the shell to the connector. A multi-piece shell requires that the pieces be electrically joined together so that they share a common ground, and good mechanical contact between the pieces is necessary. Heretofore, multi-piece shells have included latch tabs on one shell piece which engage in apertures of another shell piece, thereby locking the shell pieces together. See, for example, U.S. Pat. No. 5,281,169. However, electrical contact between the interengaging shell pieces may be deficient, and there is still a need for firmly securing the shell pieces to the connector housing. There is a need for improving the attachment of both single piece and multi-piece ground shields to a connector.

SUMMARY OF THE INVENTION

The invention is an electrical connector including a dielectric housing which holds a plurality of terminals and a conductive shell which is mounted on the housing. The housing has a wall and a pocket is formed in the wall. The shell has a locking tab which is interference fitted in the pocket, thereby anchoring the shell to the housing.

In one embodiment, the shell comprises separate front and rear shells. One of the shells has a floating tab which is freely received in the pocket and is resiliently engaged with the locking tab on the other of the shells. The locking tab may have a free end with an enlargement at the free end comprising a pair of oppositely extending ears.

BRIEF DESCRIPTION OF THE DRAWINGS

The invention will now be described by way of example with reference to the accompanying drawings wherein.

DETAILED DESCRIPTION OF A PREFERRED EMBODIMENT

Figure 1:
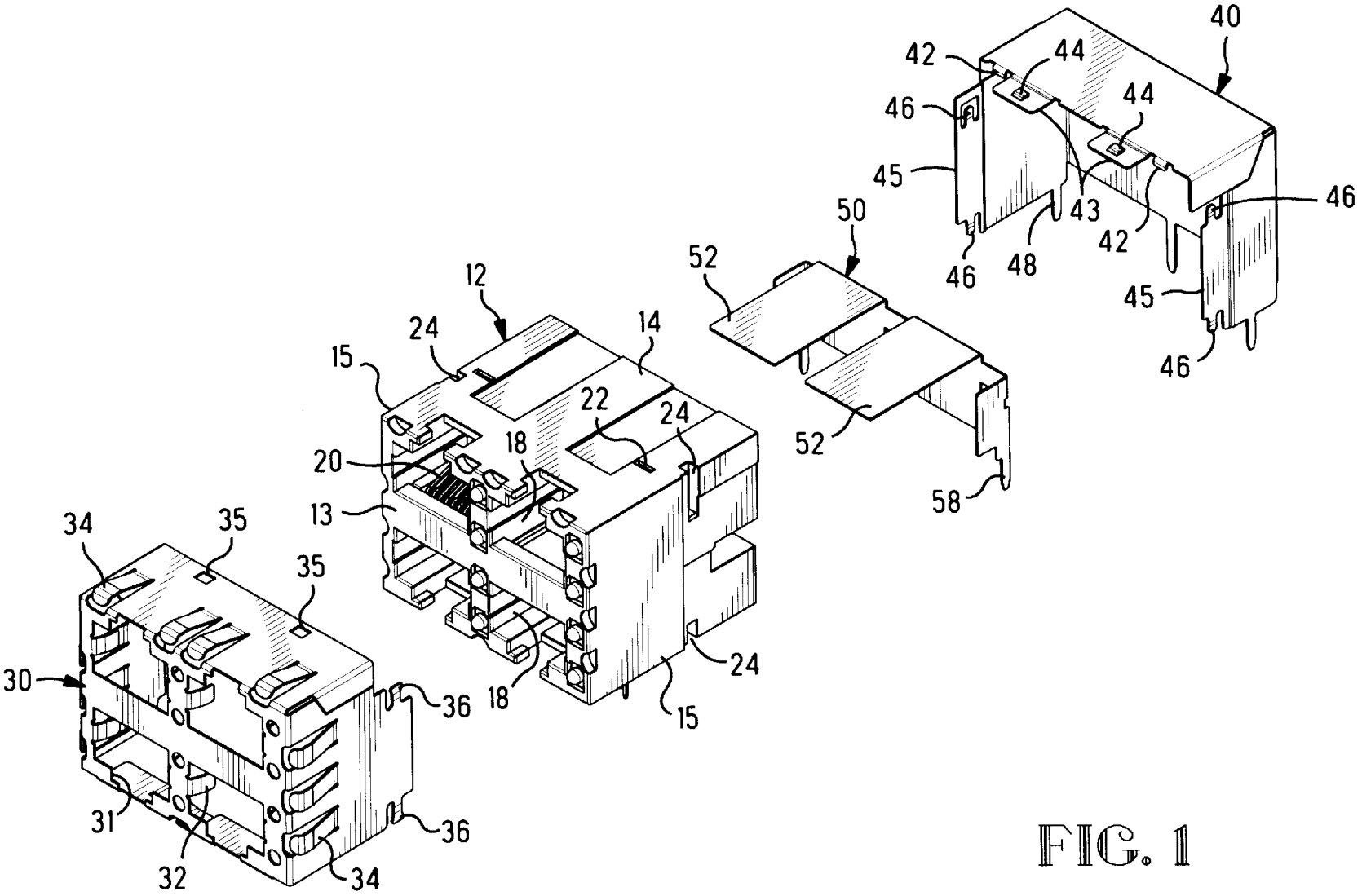
FIG. 1 is a front isometric view of an electrical connector according to the invention showing internal and external ground shields exploded away.
Figure 2:
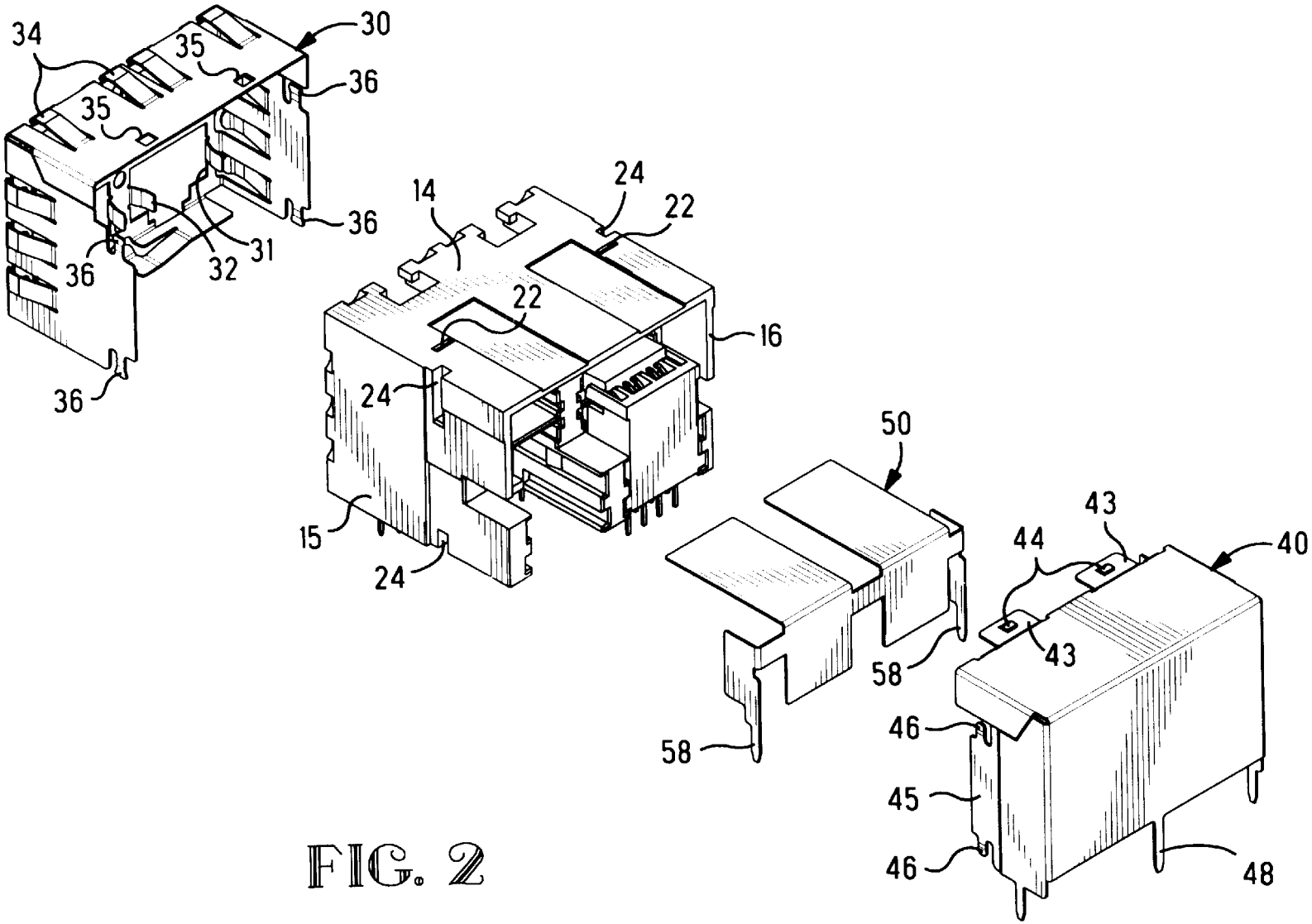
FIG. 2 is a rear isometric exploded view of the connector and ground shields.
Figure 3:
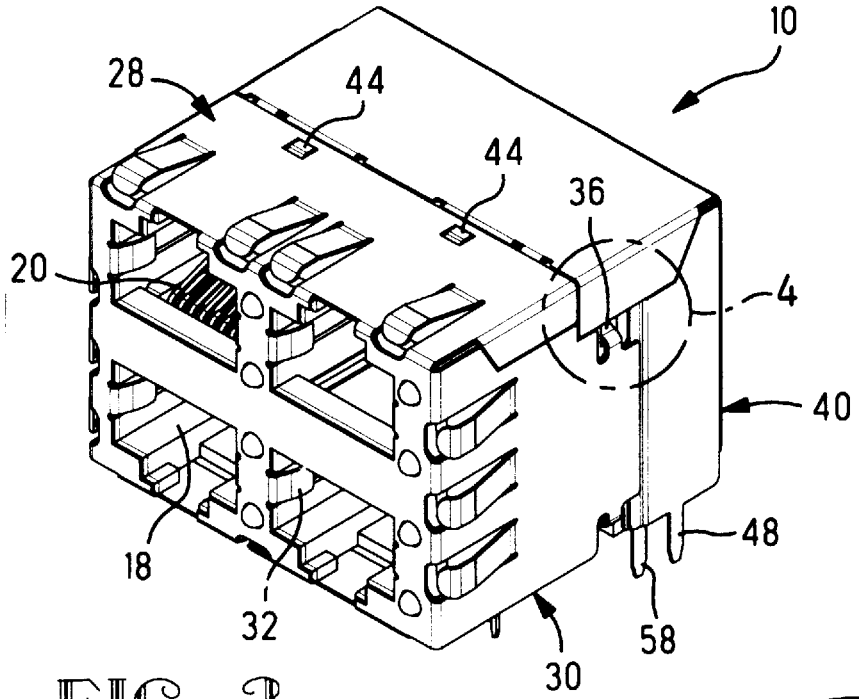
FIG. 3 is a front isometric view of the connector and ground shields in assembled condition.

There is shown in FIGS. 1–3 a shielded electrical connector 10 of a type known as a stacked modular jack which comprises a plurality of modular jacks that are integrated into a unit. The electrical connector 10 comprises a dielectric housing 12 having a front face 13, a top face 14, opposite side faces 15 and a rear edge face 16. The housing 12 in the present example has four cavities or ports 18 arranged in two horizontal rows, each of the cavities 18 being open through the front face 13 and configured for receiving a respective modular plug (not shown). The housing holds a plurality of terminals 20 which are subdivided into arrays corresponding to the cavities 18. Each array of terminals 20, only one of which is shown, extends into a respective one of the cavities 18 for engagement by contacts of a respective modular plug.

The connector 10 has an external ground shield 28 in the form of a sheet metal shell which closely encompasses the housing 12 and substantially surrounds the housing along the front face 13, top face 14, side faces 15 and rear edge face 16. The shell is made in two parts which may be termed a front shield 30 and a rear shield 40. The connector also has an internal ground shield 50 having plates 52 which are disposed in the housing between the arrays of terminals 20 of the upper and lower rows of cavities 18. Each of these shields 30, 40, 50 is stamped and formed from sheet material. The rear shield 40 and the internal ground shield 50 have respective ground tabs 48, 58 which are engagable with ground paths on a circuit board (not shown).

The front shield 30 has apertures 31 which are aligned with the cavities 18 in the housing, and resilient arms 32 which extend into the cavities for engagement with a shield on a mating modular jack which is inserted into one of the cavities. The front shield also has resilient arms 34 which engage edges of a cutout in a mounting panel (not shown) when the connector is installed in the cutout.

The front and rear shields 30, 40 are folded around the housing 12 so that they conform substantially to the shape of the housing. The rear shield has tabs 42 which enter slots 22 in the housing 12. The rear shield has flaps 43 which are overlapped by the front shield along the top face 14 of the housing, and lances 44 which are received in apertures 35 of the front shield to link the shields 30, 40 together along the top face of the housing. The rear shield has flaps 45 which are overlapped by the front shield along the side faces 15 of the housing. The rear shield has a pair of crimp tabs 46 extending in opposite direction from each of the flaps 45, and each of the crimp tabs 46 is overlapped by a respective crimp tab 36 of the front shield.

Figure 4:
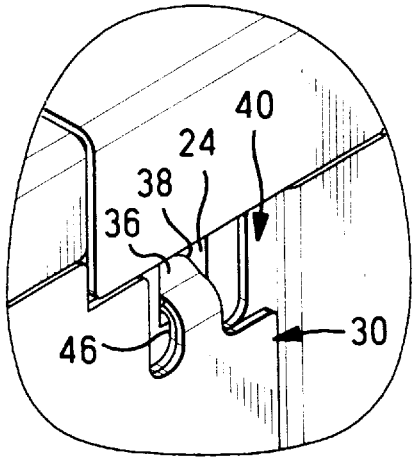
FIG. 4 is an enlarged view of a portion of the connector within boundary line 4 of FIG. 3.
Figure 5:
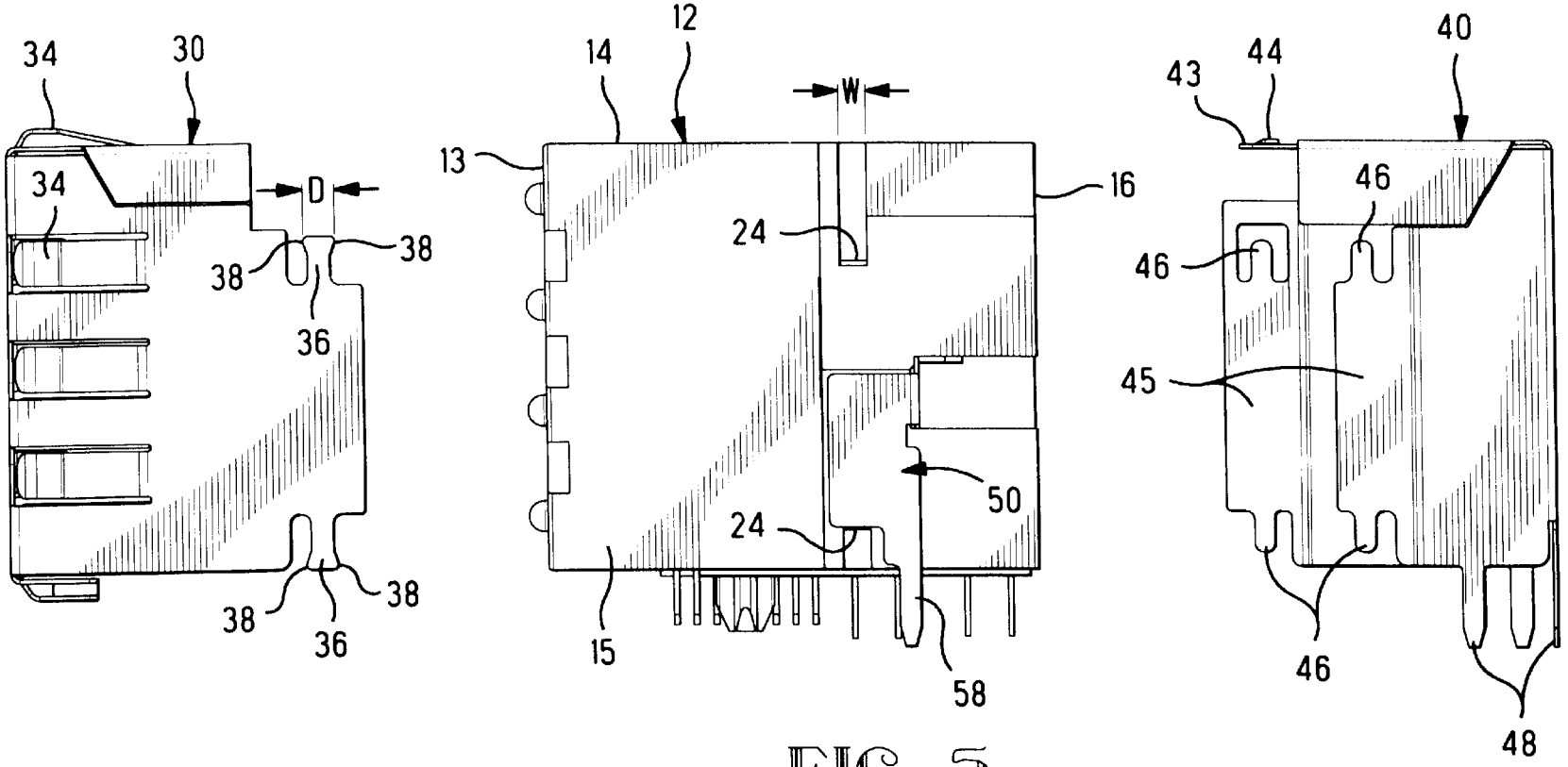
FIG. 5 is a side exploded view of the connector and external ground shields.

The housing 12 has a pair of pockets 24 in each side face 15 which receive the crimp tabs 36, 46 of the front and rear shields, as shown in detail in FIG. 4. The crimp tabs 46 of the rear shield are dimensioned so that they are freely received in the pockets, while the crimp tabs 36 of the front shield are dimensioned for an interference fit in the pockets. As such, the crimp tabs 36 may be termed locking tabs. As best seen in FIG. 5, each of the locking tabs 36 has a free end with ears 38 that form an enlargement having a dimension D that is greater than a width W of the pocket 24. During assembly of the shields to the housing, the locking tabs 36 of the front shield are bent into the pockets 24. Concurrently, the locking tabs 36 of the front shield clinch the crimp tabs 46 of the rear shield so that the crimp tabs 46 are also bent into the pockets beneath the locking tabs 36. The ears 38 of the locking tabs 36 dig into the housing along the sides of each pocket 24, thus anchoring the locking tabs 36 to the housing. Each crimp tab 46 is narrower than the width W of its respective pocket 24. The crimp tabs 46 do not become anchored to the housing but are instead permitted to float in the pockets 24. Accordingly, the crimp tabs 46 may be termed floating tabs. Bending of the floating tabs 46 results in both plastic and elastic deformation of the floating tabs. This elastic deformation results in stored energy in the floating tabs 46 which tends to spring the floating tabs back at least partially to their undeformed position. Since the floating tabs 36 of the front shield are anchored to the housing, the floating tabs 46 of the rear shield exert a resilient force on the locking tabs 36, thereby ensuring that the floating tabs 46 are in loaded engagement with the locking tabs 36, which loaded engagement promotes a low resistance electrical path between the shields.

Figure 6:
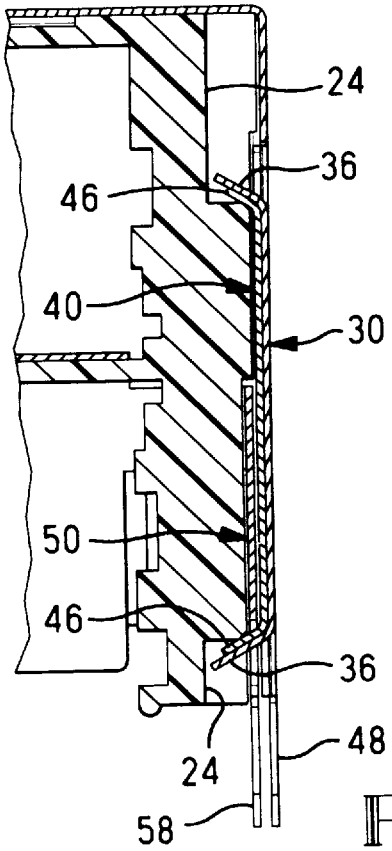
FIG. 6 is an enlarged cross-sectional view through a portion of the connector assembly.

As shown in FIG. 6, the locking tabs 36 and floating tabs 46 are preferably bent at an angle which is less than ninety degrees to the side face 15 in order to prevent bottoming of the floating tab 46 in the pocket 24, thereby permitting some float of the rear shield 40 which is advantageous for equalizing normal force between upper and lower pairs of the locking and floating tabs 36, 46.

Although the invention has been shown and described in relation to a four port stacked modular jack connector, it should be understood that the invention can be readily applied to modular jacks of different port arrangements including single port modular jacks, and to various other connector styles such as circular DIN connectors.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. An electrical connector comprising:

a dielectric housing which holds a plurality of terminals, and a conductive shell mounted on the housing, the housing having a wall and a pocket in the wall, the pocket having a width, and the shell having a locking tab with a width which is greater than the width of the pocket, the locking tab being bent into the pocket wherein the locking tab is interference fitted in the pocket due to the width of the locking tab being greater than the width of the pocket, thereby anchoring the shell to the housing.

2. The electrical connector of claim 1 wherein the locking tab has a free end and an enlargement at the free end, and the width of the locking tab is defined by the enlargement.

3. The electrical connector of claim 2 wherein the enlargement includes a pair of oppositely extending ears.

4. The electrical connector of claim 1 wherein the shell has a floating tab with a width which is less than the width of the pocket, the floating tab is bent into the pocket beneath the locking tab and is resiliently engaged with the locking tab within the pocket.

5. The electrical connector of claim 4 wherein the shell comprises separate front and rear shells.

6. The electrical connector of claim 5 wherein the locking tab and the floating tab are integral with respective different ones of the front and rear shells.

7. The electrical connector of claim 6 wherein the locking tab has a free end and an enlargement at the free end, and the width of the locking tab is defined by the enlargement.

8. The electrical connector of claim 7 wherein the enlargement includes a pair of oppositely extending ears.

* * * * *